US005154288A

United States Patent [19]

Glöyer

[11] Patent Number: 5,154,288

[45] Date of Patent: Oct. 13, 1992

[54] MULTIPACK

[76] Inventor: Wolfgang Glöyer, Borsigstrasse 5, D-2057 Reinbek, Fed. Rep. of Germany

[21] Appl. No.: 555,384

[22] PCT Filed: Feb. 6, 1988

[86] PCT No.: PCT/DE89/00074

§ 371 Date: Oct. 3, 1990

§ 102(e) Date: Oct. 3, 1990

[87] PCT Pub. No.: WO89/07075

PCT Pub. Date: Aug. 10, 1989

[30] Foreign Application Priority Data

Feb. 5, 1988 [DE] Fed. Rep. of Germany ..... 3803392
Feb. 11, 1988 [DE] Fed. Rep. of Germany ..... 3804211
Feb. 27, 1988 [DE] Fed. Rep. of Germany ..... 3806337
Mar. 8, 1988 [DE] Fed. Rep. of Germany ..... 3807447

[51] Int. Cl.[5] ..... B65D 71/06

[52] U.S. Cl. ..... 206/427; 229/120.25

[58] Field of Search ..... 206/139, 142, 143, 147, 206/193, 201, 427, 428, 432, 497, 45.33; 211/73; 229/120.23, 120.25, 120.26

[56] References Cited

U.S. PATENT DOCUMENTS 2,680,039 6/1954 Burge ..... 206/147
2,697,547 12/1954 Wagonseller ..... 229/120.26
2,723,796 11/1955 Malmgren ..... 229/120.26
2,792,982 5/1957 Malmgren ..... 206/45.33
2,821,299 1/1958 Crary ..... 206/428
2,925,209 1/1960 Wasyluka ..... 229/120.25
3,152,744 10/1964 Vrana ..... 229/120.25
3,817,373 6/1974 Samsing ..... 211/73
4,144,995 3/1979 Travis ..... 229/120.23
4,523,676 6/1985 Barrash ..... 206/428

FOREIGN PATENT DOCUMENTS 0616554 3/1961 Canada ..... 229/120.26

*Primary Examiner*—Jimmy G. Foster
*Attorney, Agent, or Firm*—Anderson Kill Olick & Oshinsky

[57] ABSTRACT

In order to provide a marketable, self-supporting multipack for containers which requires only a small quantity of packaging material and which shows the packed contents such as cans and jars open in their entire height, which is easy to handle and which possesses a good inherent stability for the transport of goods from the manufacturer, via the trade, to the consumer, it is proposed to make provision in a multipack for several containers having the same configuration and height for the one-piece cardboard blank (10;12;20), at its corner areas, to be provided with a flap (18,19) each that can be erected at an angle of 90°, that the flaps (18,19) of the cardboard blank (10;12;20) are disposable between two container walls (13*a*), that the bottom surface areas (11;21) of the carboard blank (10;12;20) are smaller than or equally large as the base of the four or six containers (13, 14), that the bottom surface area (11;12) of the carboard blank (10;12;20) comprises the bottom surface area or at least a part of the bottom surface area of the bottoms of the containers (13,14) and that an encircling band (15) girdling the multipack is disposed at approximately half the height of the container walls (13*a*) and unites the cardboard blank (10;12;20) with the containers into a sturdy multipack.

6 Claims, 9 Drawing Sheets

MULTIPACK

A multipack according to the present invention is suitable for an easily handled package that can, if necessary, be used for stacking on pallets which holds a larger number of inherently stable containers of uniform configuration and size for transport and storage and which can also be employed as a sales, display and supply package. It renders possible a rapid economical combination of such containers by packaging machines. These may be cans or containers of—in the widest possible interpretation—cylindrical shape, and having a circular, elliptical or polygonal cross-section, or else they may be bottles, which, at least on one part of the height of their outer casing, are of cylindrical configuration. A preferred area of application of the invention is the distribution of beverages in containers for liquids. It is also possible to combine containers of other media, such as foodstuff preserves, cleaning agents or engine oils in multipacks according to the invention.

BACKGROUND OF THE INVENTION

The invention proceeds from a multipack for an even number of four, six or more cylindrical, square or polygonal containers disposed in two longitudinal rows standing in a side-by-side arrangement and having the same shape and size, which is comprised of the containers, a square or rectangular cardboard blank with unfolded flaps and an encircling band which girdles the multipack, in which the bottom areas of the cardboard blanks are smaller than or equally large as the base area of the containers disposed side-by-side and comprises the bottom area or at least a portion of the bottom area of the bottoms of the containers, and in that the encircling band girdling the multipack is disposed approximately halfway up the height of the container walls and unites the cardboard blank together with the containers in such a way as to form a sturdy multipack, and in that, in the bottom wall, at least one oblong flap formed from the latter with transversally extending fold is provided which, when folded upwardly at an angle of 90°, forms a transversal web serving to prevent the slipping out of position in the longitudinal direction of the containers, as is known from the WO 85/03274.

From the U.S. Pat. No. 2,792,982, a tray for cakes, candies, fruit or the like is already known in which, for the formation of partitioned-off compartments, folds are provided which are formed from the bottom wall and extend in the transverse direction and can be folded upwardly at an angle of 90°.

In order to form a number of equally large areas within a cardboard box it is already known to divide or cut up a blank in such a way that two longitudinally divided portions from the base portion are mounted transversally on the latter and interconnected with the aid of a further longitudinally mounted portion, the thusly formed separate being insertable into a cardboard box (U.S. Pat. No. 3,702,170).

From the U.S. Pat. No. 4,144,995 it is known to unfold, from a basic blank comprised of a rectangular plate with appended angled portions, a separator in such a way that, subsequent to inserting the separator into a cardboard box, compartments having a trapeziform cross-section for the accommodation of cups or the like are formed.

From the U.S. Pat. No. 2,687,706 it is known to form, from a basic blank, a number of uniform compartments in that, in the blank, elongated flaps with transversally extending fold are provided which are folded in the upward direction at an angle of 90° and connected to a number of longitudinal webs engaging into the same.

The present invention is based on the technical problem of providing a marketable, self-supporting multipack for containers which only requires a small quantity of packaging material and which shows, openly from the outside, the packed contents such a cans or jars or bottles in their full height, which is easy to handle and which possesses a good inherent stability for the transport of the goods from the manufacturer to the consumer via the trade.

SUMMARY OF THE INVENTION

A first alternative solution for the above problem consists in that a cardboard blank is provided with four flaps at its for corners which can be folded out at an angle of 90°. The containers are placed on this cardboard blank with the folded-out flaps in such a way that the flaps are in each case disposed between two container walls. Following this, the containers standing on the cardboard blank are, in a plane parallel to the bottom area, connected to the multipack with the air of at least one encircling band.

Such a multipack for preferably cylindrical cans or preserve jars only requires an extremely small area of cardboard material for forming the blank, yet nevertheless provides a firm cohesion by means of the encircling band welded under tension which adapts itself to the container configuration. If the containers are provided with a fitted circumferential groove having the width of the encircling band, the strength of the multipack is increased and the encircling band is additionally secured against slipping out of position on the container walls.

For identifying the multipack, the bottom surface area of the blank may be printed over or be provided with labels. The new multipack possesses the advantages of having a light weight, great economy as well as that a large portion of the outer surface areas of the individual container packed in the multipack is exposed, thus provided the possibility of affixing price tickets on the same without that an opening is necessary. The printed-over or labeled containers, such as cans, jars or bottles, remain visible in their full length. The arrangement of the containers on the bottom surface area of the cardboard blank and the position of the erected flaps between, in each case, two container walls, secured the containers against sliding out of position and, together with the encircling band, provides a sturdy transport package. The bottom of the cardboard blank of the multipack can be printed over or be provided with labels for identification purposes.

A further alternative consists in that the blank fabricated from cardboard or plastic material, on its two narrow ends, is provided with two flaps each that are interconnected by two webs which are folded out at an angle of 90° and the height of which adapts itself to the height of the cylindrical portion of the containers. The containers are disposed on the bottom of the blank in such a way that a bottom flap each is located between four container walls. Subsequently the four containers standing on the blank are, on a plane parallel to the bottom area, firmly united with the multipack by means of at least one encircling band.

Such a multipack for preferably six tall cylindrical preserve cans or jars as well as for cylindrical bottles necessitates a relatively small area of packaging material for the formation of the multipack, but, notwithstanding this, due to the adapted height of the bottom flaps which are disposed between the four container walls, it ensures a good and firm cohesion by means of the ring of encircling band welded under adjustable tension, which is applied around the container walls. If the containers are provided in their walls with a circumferential fitted groove having the width of the encircling band, the strength of the multipack is increased and the encircling band is additionally secured against slipping out of position on the container wall.

The bottom surface area of the blank can be printed over or be provided with labels for identification or marking of the multipack. The new multipack offers the advantage of a very light weight, great economy as well as the fact that a large portion of the outer surfaces of the containers packed in the multipack are exposed which renders the affixing of price tickets on them possible without any opening being needed for this.

Yet another alternative consists in that the blank fabricated from cardboard or also plastic material is, on two sides of its bottom area, provided with a strap-like flap each which are unfolded at an angle of 90° and remain connected to the bottom area by means of the webs on the outer ends of the bottom flap. The height of the unfolded bottom flaps adapts itself to the height of the cylindrical portion of the containers. On at least one longitudinal side of the multipack, a side wall with notches or slot-like recesses is located which can be folded out at an angle of 90° relative to the unfolded bottom flaps. On the bottom of the cardboard blank with the unfolded bottom flaps and the side wall, the containers are arranged in such a way that a bottom flap each is located between four container walls. The notches or slot-like recesses in the side wall keep the encircling band in position in a plane parallel to the bottom surface and prevent a slipping out of position of the band on the side wall and on the container walls. Such a multipack for cans or jars as well as for bottles requires a comparatively small quantity of packing material and, by means of the angular functions of the bottom flaps and the side wall together with the encircling band, secures the position of the containers on the bottom of the multipack. The encircling band welded under adjustable tension wraps itself around the outer container walls and is thereby in each case in contact with one fourth of the outer container walls. The bottom surface area of the cardboard blank covers the bottom area of the containers or at least a part of the bottom area and forms a cardboard layer between the containers when being stacked and palletized. The external visible sides of the bottom and side wall can be printed over or provided with labels for identification or advertising purposes. The new multipack possesses the advantage of having a light weight, great economy, being automatically erected, filled and encircled with a band, as well as the fact that the containers are exposed on three sides and the advertising space on one longitudinal side with the possibility of affixing price tickets on the individual containers and the removal of the containers without having to have recourse to a tool, in which case the center container on the side wall is removed first. The printed-over or labeled containers, such as cans, jars or bottles, remain visible in full length from the outside. The arrangement of the containers on the bottom area of the cardboard blank and the position of the raised bottom flaps between four container walls at a time secures the containers against a sliding out of position and, together with the tension of the ring of encircling band, forms a sturdy, self-supporting multipack for being transported on pallets or by hand. The bottom of the cardboard multipack can be printed over or be provided with labels for identification purposes. The removal of the containers is possible without tools provided that the container in the center between the two bottom flaps and the side wall is removed first.

The essential solution concept in all the embodiments consist in that the outer walls ensuring a stable cohesion have been displaced inwardly between the containers.

BRIEF DESCRIPTION OF THE DRAWINGS

Embodiments of the invention are depicted in the drawings, thus

DETAILED DESCRIPTION OF THE PREFERRED EMBODIMENT

Figure 1:
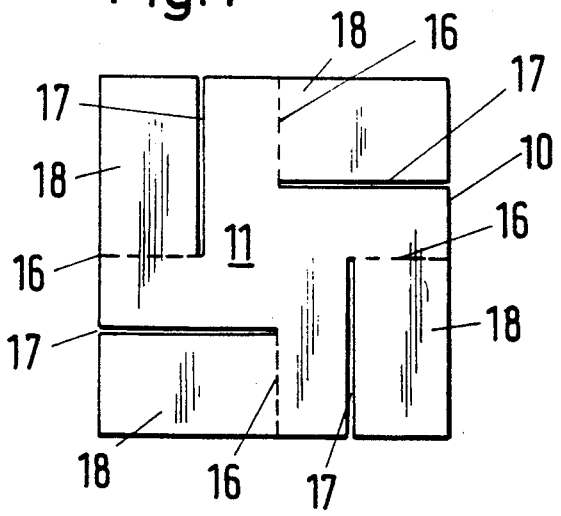
FIG. 1 shows the outline of the flat blank for four containers with the slot-like recesses and weakened lines for the formation of the bottom flaps.

In FIG. 1, the blank is identified with 10 and the bottom of the multi-pack 50 with 11. Weakened lines or transverse folds 16 and slot-like recesses 17 are provided.

Figure 2:
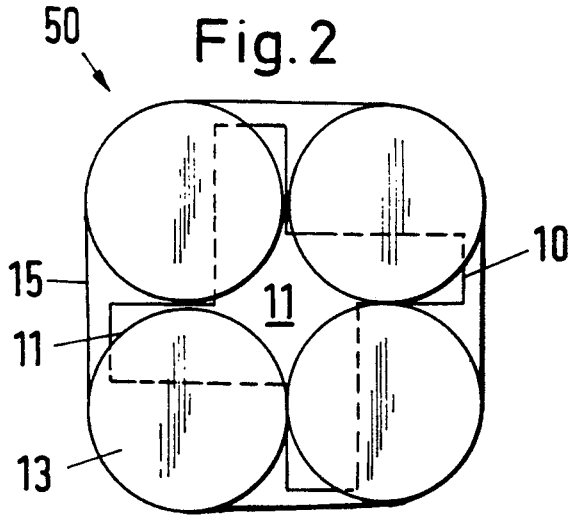
FIG. 2 shows the blank according to FIG. 1 with the raised bottom flaps and four cylindrical containers between whose container walls two bottom flaps each are located as well as the encircling band girdling the multipack, FIG. 3, in a perspective top view, shows the position of the ring of encircling band in the multipack for four cans according to FIG. 2, in which the cardboard blank with the folded-out bottom flaps between the cans is scarcely visible.

In FIG. 2, the bottom flaps are unfolded and are in each case located between two cylindrical containers 13. The multipack is girdled by the encircling band 15.

Figure 3:
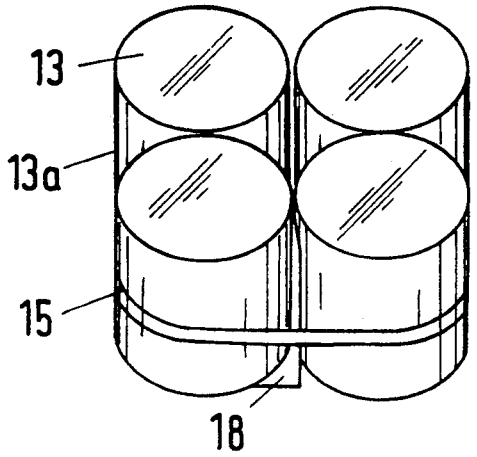

FIG. 3 shows a perspective view of the multipack for four cans 13, in which the blank 10 is hardly visible close to a can standing on the bottom.

Figure 4:
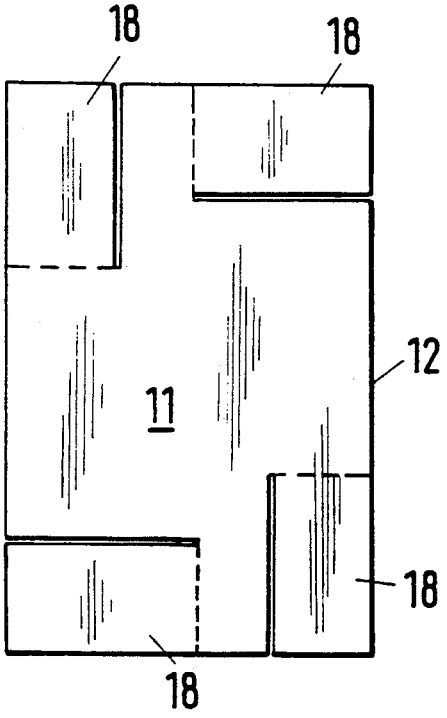
FIG. 4 shows the outline of the flat blank for six containers with the slot-like recesses and weakened lines for the formation of the four flaps.
Figure 5:
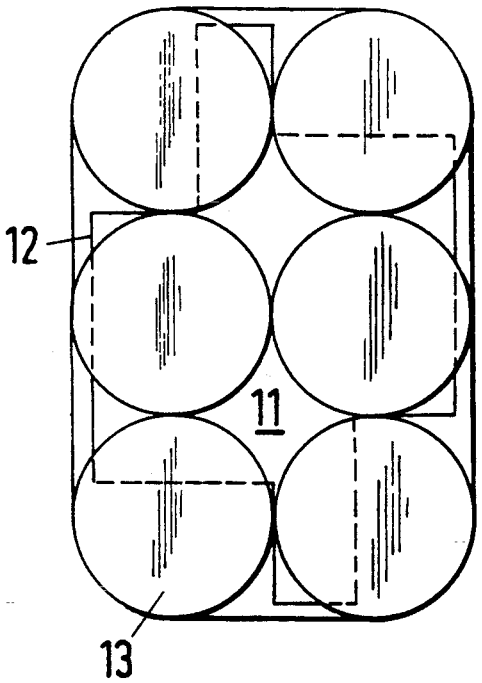
FIG. 5 shows the same blank as FIG. 4 with the four unfolded flaps and the arrangement of six cylindrical containers which are each retained by at least one bottom flap in their position on the bottom of the blank.
Figure 6:
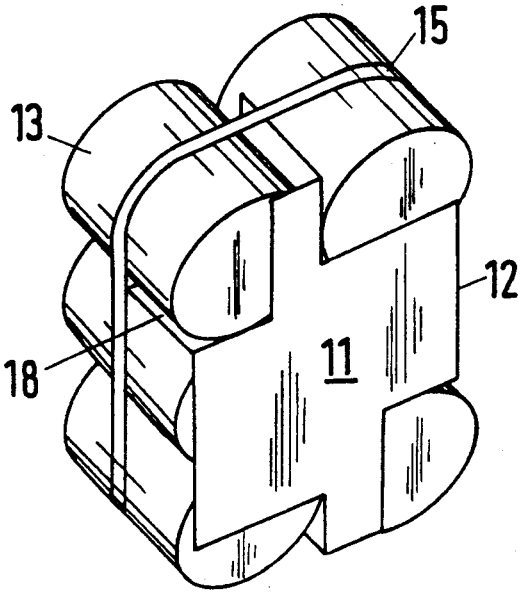
FIG. 6 shows the same multipack as FIG. 5 with the girdling encircling band in a perspective view from below.
Figure 7:
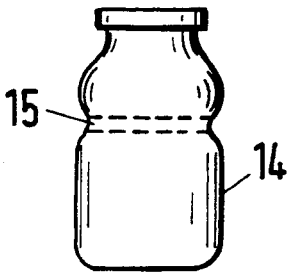
FIG. 7 shows a cylindrical jar with cover and a circumferential groove constructed in the jar wall.

FIGS. 4, 5 and 6 show the multipack for six cans 13, in which the central row of cans stands on the widened bottom area 11. Due to the surface area dimension of the blank 12, length to width at a ratio of 3:2 and on account of the enlarged bottom area 11, in this multipack a self-supporting stacking combination exists. For purposes of identification, the bottom surface area 11 may be printed over or be provided with labels. FIG. 7 shows the side elevation of a preserve jar 14 with a fitted circumferential groove in the container wall 13*a*, in which 15 indicates the position of the ring formed by the encircling band.

Figure 8:
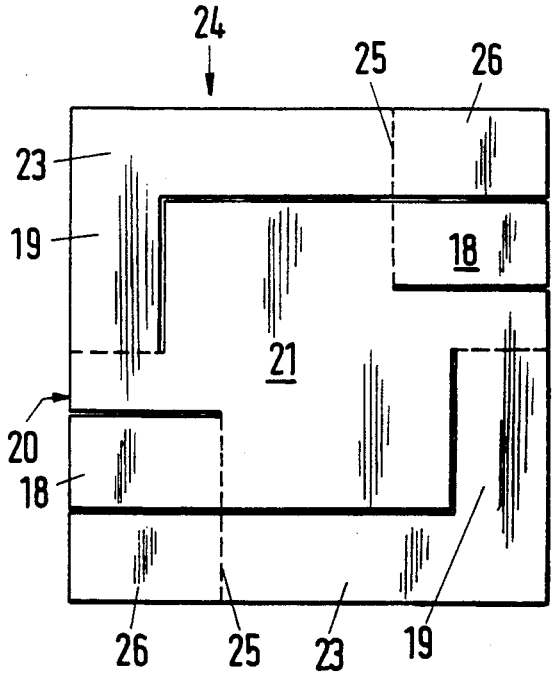
FIG. 8 shows the outline of the flat blank of a multipack for six tall containers with two opposite enlarged bottom flaps.

FIG. 8 shows the outline of a flat blank 20 of a multipack for six tall containers such as bottles with two opposite, enlarged L-shaped bottom flaps 19 which meet in the center when being folded out and which form a web 22 across the length of the blank 20. It is possible to interconnect the bottom flaps 19 with the aid of adhesive or staples.

Figure 9:
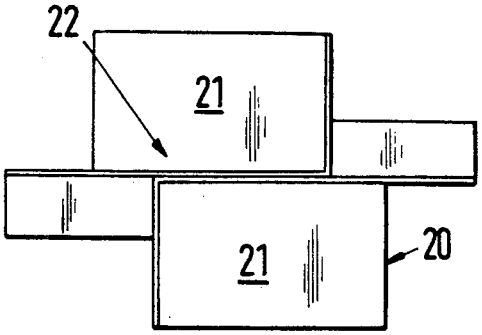
FIG. 9 shows the blank according to FIG. 8 with raised bottom flaps.

FIG. 9 shows the blank with raised bottom flap in a top view.

Figure 10A:
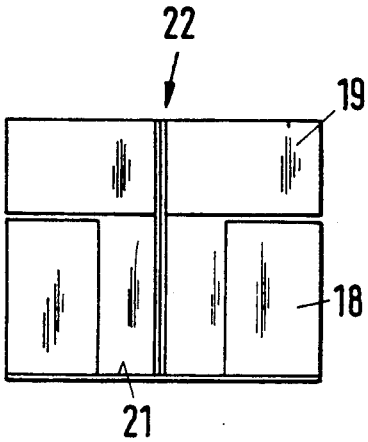
FIGS. 10 and 10*a* show the side elevations of the blank according to FIG. 9.
Figure 10:
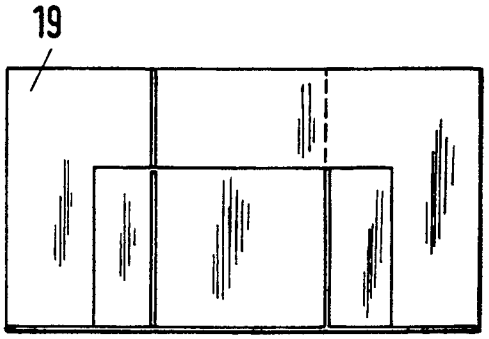

FIGS. 10 and 10*a* show the side elevations of the blank according to FIG. 9. Provision is made in this case that the two flaps 19 of L-shaped construction possess an additional enlarging portion 23 overlapping one longitudinal side 24 of the cardboard blank 10;12;20, and that the L-shaped flaps 19 have an inserting portion 26 partitioned off by a transverse fold 25.

Figure 26:
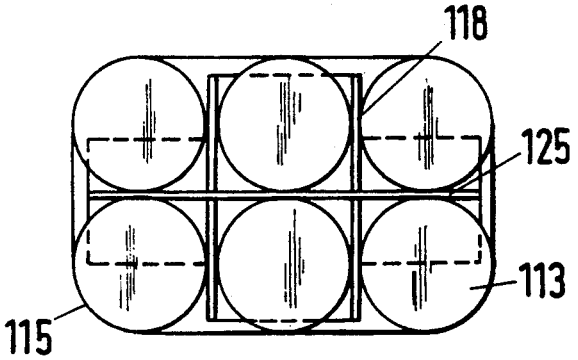
FIG. 26 shows the top view of a multipack according to FIG. 25 with six cylindrical containers between whose points of contact one wall each of the bottom flaps or of the transverse web is located. The bottom surface area of the cardboard blank covers the bottom area of the cylindrical container or at least a part of the bottom area of all cylindrical containers in the multipack. The encircling band girdling the package unites the container and the compartment so as to form the multipack.

In FIG. 26, the blank is identified with 110 and the bottom of the multipack 100 for six containers with 111. Weakened lines 116 and slot-like recesses 117 are provided for forming the the bottom flaps 118 with the webs, while the bottom flap 119 in the center row serves to lock the containers in position.

Figure 11:
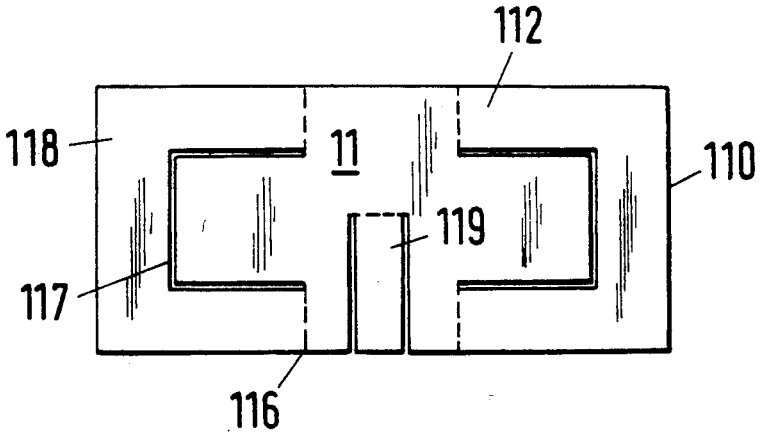
FIG. 11 shows the outline of the flat blank of the multipack for six containers with the slot-like recesses and weakened lines for the formation of the bottom flaps.
Figure 12:
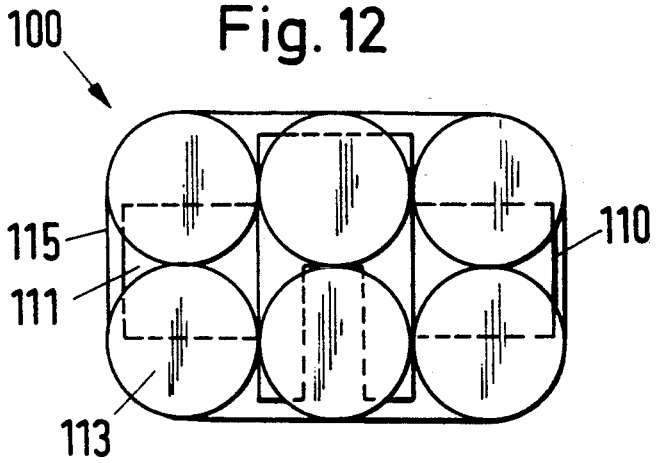
FIG. 12 shows the blank according to FIG. 11 from the top with folded-out bottom flaps and six cylindrical cans between whose walls the bottom flaps are located as well as the encircling band which girdles the multipack.

In FIG. 12 the bottom flaps 118 according to FIG. 11 are unfolded and located between the container walls 113*a* of the cylindrical cans 113. The encircling band girdling the multipack 100 is identified with 15.

Figure 13:
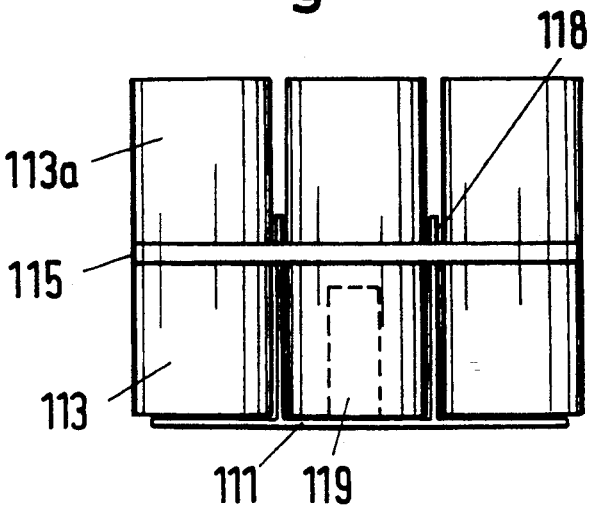
FIG. 13 shows the side elevation of the multipack according to FIG. 12 with six tall, cylindrical cans as well as the position of the encircling band.

FIG. 13 shows the side elevation of the multipack according to FIG. 12 with six tall cylindrical cans, between the container walls of which the bottom flaps prevent a sliding out of position within the pack, and 115 indicates the position of the ring formed by the encircling band. Provision is made in this case for an additional bottom flap 119 to be disposed in the center of the bottom 111 in such a way that the location of the folded-out flap 119 is between the two container walls in the center row and secures the containers against a lateral displacement within the multipack.

Figure 14:
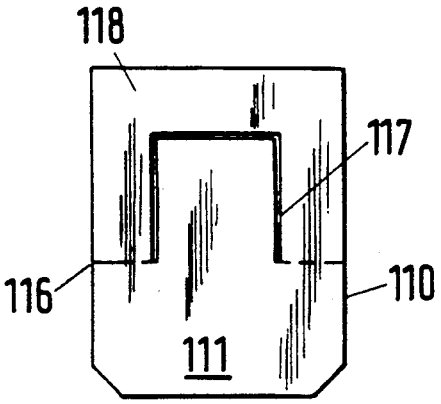
FIG. 14 shows the outline of the flat blank of the multipack for four containers with the slot like recesses and weakened lines for the formation of the bottom flaps.

In FIG. 14 the blank is identified with 110 and 111 identifies the bottom of the multipack for four containers. The weakened lines or folds are identified with 116 and the slot-like recesses for the formation of the bottom flap 118 with the webs with 117.

Figure 15:
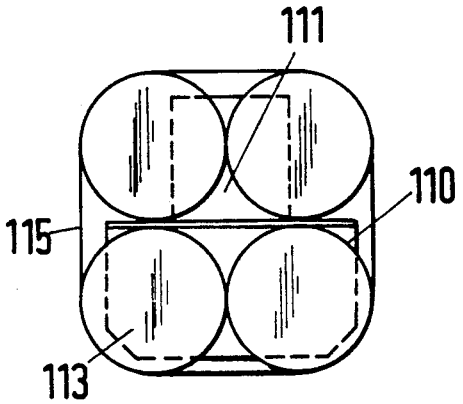
FIG. 15 shows the blank according to FIG. 14 from the top with the unfolded bottom flap and four cylindrical cans between whose walls the bottom flap as well as the encircling band girdling the multipack are located.

In FIG. 15, the bottom flap 118 according to FIG. 14 is folded-out and located between four container walls of the cylindrical cans 113. 115 indicates the girdling encircling band.

Figure 16:
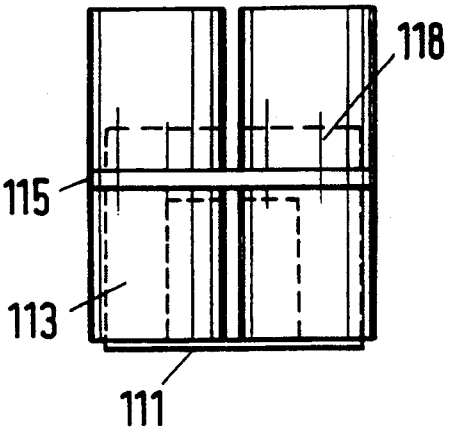
FIG. 16 shows the side elevation of the multipack according to FIG. 15 with four tall cylindrical cans and the position of the ring of the encircling band.

FIG. 16 shows the side elevation of the multipack for four tall cans according to FIG. 5 and the position of the ring formed by the encircling band 115.

Figure 17:
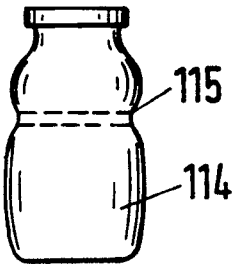
FIG. 17 shows the side elevation of a preserve jar with a circumferential groove fitted in its wall.

FIG. 17 shows the side elevation of a preserve jar 114 with a fitted circumferential groove in the container wall, with 115 indicating the position of the ring formed by the encircling band.

Figure 18:
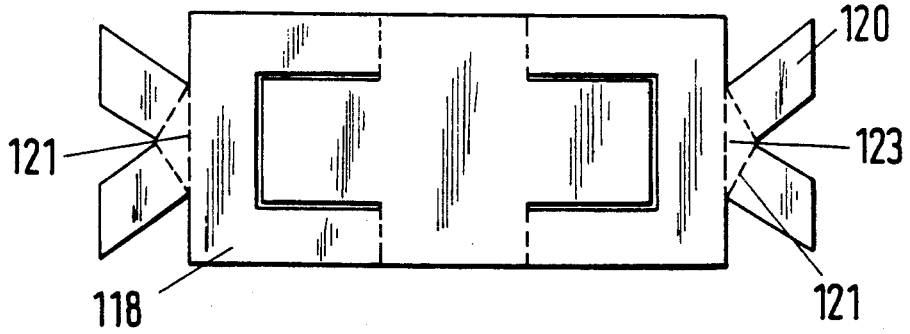
FIG. 18 shows the outline of a one-piece cardboard blank in which the two unfoldable bottom flaps according to FIG. 11 are additionally provided with two inwardly foldable tabs each which, subsequent to the inward folding along the weakened lines, form trilateral columns in the center parallel to the walls of the bottom flaps. These columns within the unfolded bottom flaps rest against the walls of the two containers in the center line and prevent a lateral displacement in the multipack and, at the same time, increase the bending resistance of the bottom flaps, FIG. 19, in a perspective view, shows the unfolded blank according to FIG. 18 prior to being filled with the cylindrical containers, FIG. 20, in a top view, shows the cardboard blank according to FIG. 18 with the two trilateral columns within the bottom flaps folded out in a U-shaped manner, FIG. 21, in a top view, shows the multipack filled with six cylindrical containers and the position of the trilateral columns between the container walls as well as the encircling band girdling the multipack.

FIG. 18 shows, in the center of the frontal area of the bottom flap 118, two additional inwardly foldable tabs 120 which, subsequent to the inward folding along weakened lines 121, together with the wall of the bottom flap, form a triangular column which, in the upward direction, is terminated by a triangular frontal area 123.

Figure 19:
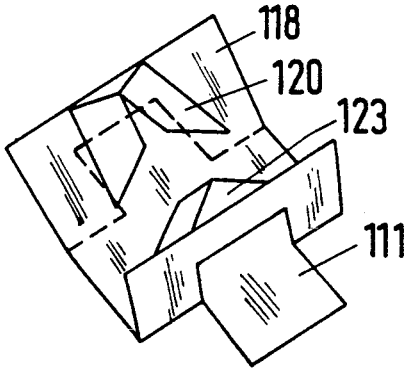

FIG. 19 shows the inward folding of the tabs 120 and the formation of the frontal areas 123.

Figure 20:
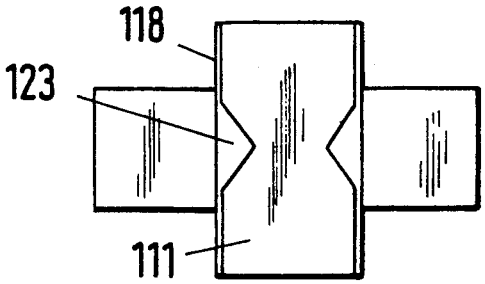
Figure 21:
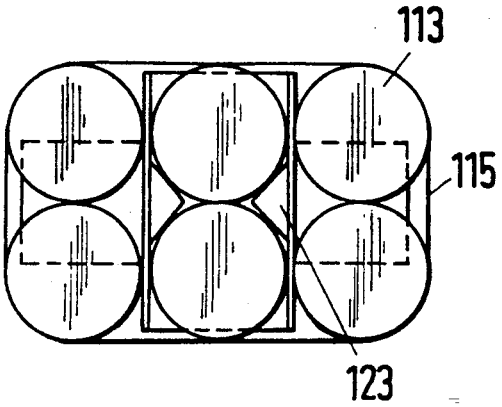

FIG. 20 shows the blank according to FIG. 20 with six cylindrical containers 112, the position of the frontal area 123 of the triangular column between the containers in the center row and the encircling band 115 girdling the multipack.

Figure 22:
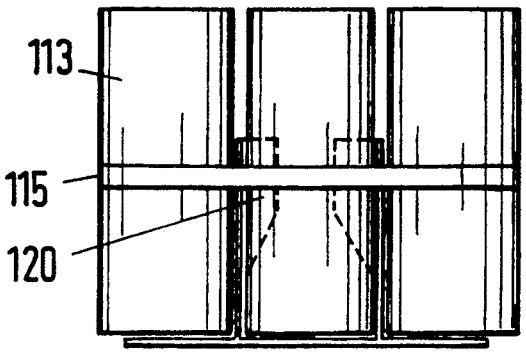
FIG. 22 shows a side elevation of the multipack with six cylindrical cans and the tabs of the trilateral columns resting against the can walls in the center of the bottom flaps as well as the position of the ring formed by the encircling band at approximately half the height of the container walls.

FIG. 22 shows the position of the inwardly folded tabs 120 between the container walls.

Figure 23:
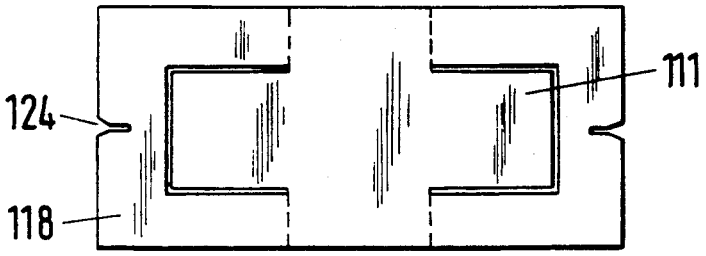
FIG. 23 shows a cardboard blank according to FIG. 11 in which the two bottom flaps are provided with a vertical slot in the center of the upper frontal area. After the unfolding of the bottom flaps, a transverse web according to FIG. 24 with two parallel slots is mounted from above onto the two bottom flaps at the distance of the bottom flaps from each other so that a sturdy compartment is formed which has a bottom surface area whose length corresponds to the length of the transverse web.

FIG. 23 shows the cardboard blank according to FIG. 11, in which the bottom flaps 118 in the upper side area are provided in the center with a vertical slot 124.

Figure 24:
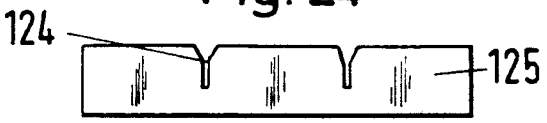

In FIG. 24, the transverse web 125 with two slots 124 is shown.

Figure 25:
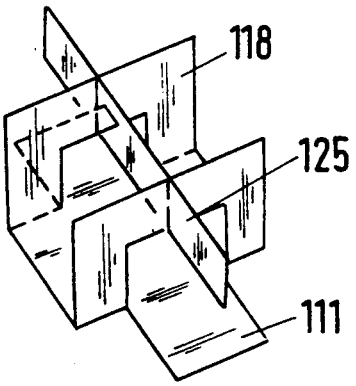
FIG. 25 shows a two-piece blank having the shape of a compartment according to FIGS. 23 and 24 in a perspective view.

FIG. 25, in a perspective view, shows the unfolded blank according to FIG. 23 and the mounted transverse web according to FIG. 24.

Figure 27A:
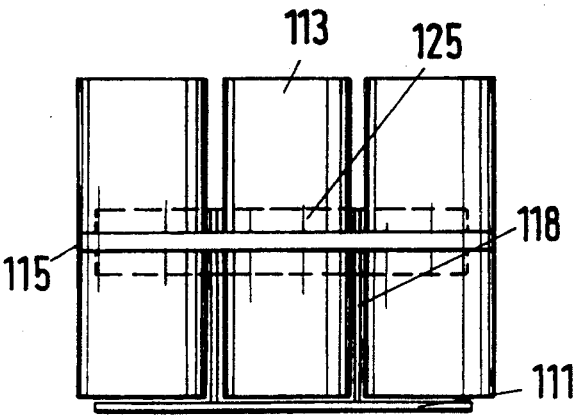
FIGS. 27*a* and 27*b* shows the side elevation of the multipack according to FIG. 26 with six cans and the position of the transverse web within the multipack as well as the position of the ring formed by the encircling band.
Figure 27B:
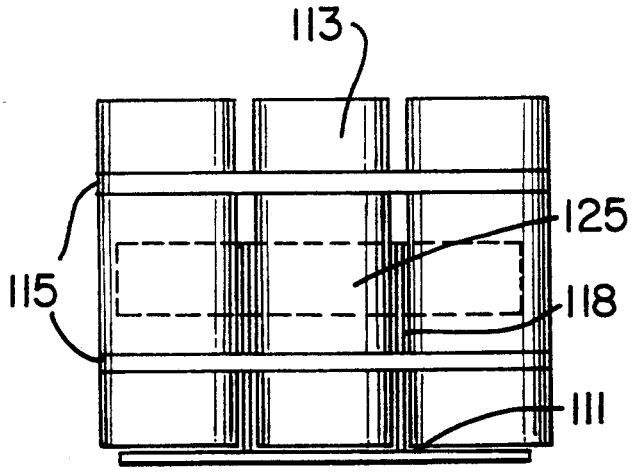

FIG. 26 shows the position of the bottom flap walls 118 and of the transverse web 125 between the container walls from the top and FIGS. 27*a* and 27*b* shows this viewed from the side.

FIG. 27*a* shows a single band, and FIG. 27*b* shows plural bands.

Figure 28:
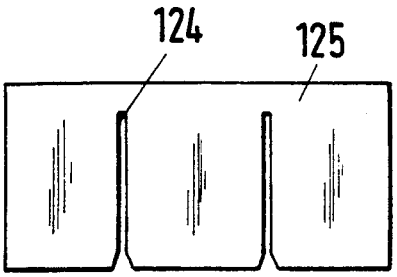
FIG. 28 shows a wide transverse web which, subsequent to being mounted on the bottom flaps, reaches the bottom of the blank.

FIG. 28 shows a wide transverse web 124 with two slots that is in contact with the bottom areas of the cardboard blank after the insertion.

Figure 29:
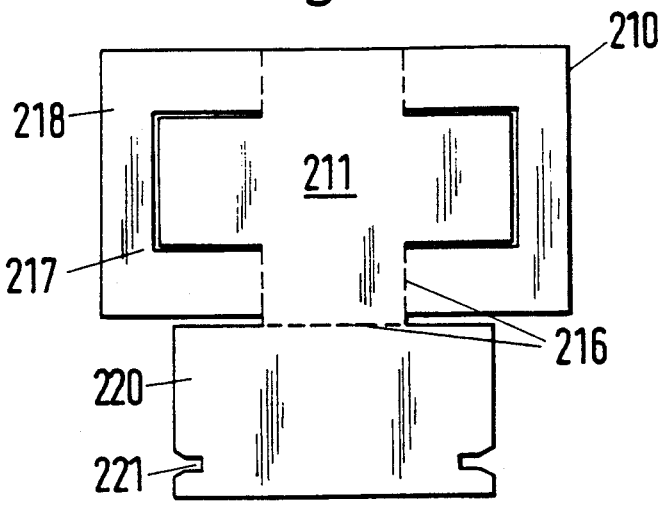
FIG. 29 shows the outline of the flat blank of the multipack for six containers with the slot-like recesses and notches for the formation of the bottom flaps and the side wall.

FIG. 29 shows the flat cardboard blank 210 with the bottom portion 211, the bottom flaps 218 and the side wall 220. 216 indicates the weakened lines, 217 the slot-like recesses and 221 the cutouts in the side wall 220 intended for guiding the ring formed by the encircling band.

Figure 30:
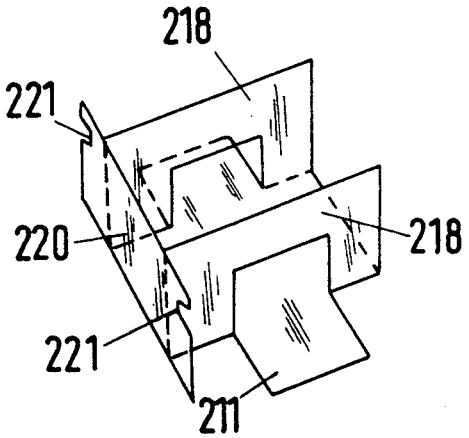
FIG. 30 shows the blank according to FIG. 29 in a perspective view with the unfolded bottom flaps and the folded-out side wall with the notches for guiding the ring formed by the encircling band.

In a perspective view, FIG. 30 shows the blank according to FIG. 29 with the bottom portion 211, the unfolded bottom flaps 218 and the side wall 220 with the cut-outs 221 on the sides.

Figure 31:
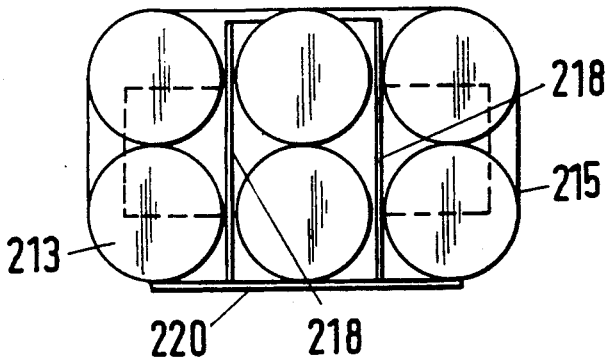
FIG. 31 shows the top view of the multipack according to FIG. 30 with six cylindrical containers from above. Between the container walls arranged in pairs, a wall each of the bottom flap is located. The side wall is in contact from the outside with one container each of a row of containers.

FIG. 31 shows the blank per FIG. 30 from the top with a six cylindrical containers 213, between which the bottom flaps 218 are located. 220 indicates the side wall and 215 the encircling band girdling the multipack.

Figure 32:
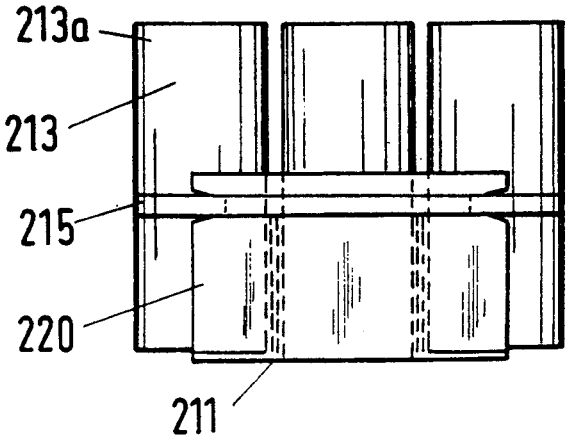
FIG. 32 shows the side elevation of the multipack according to FIG. 31 with cylindrical cans and the position of the side wall on the container walls as well as the position of the ring formed by the encircling band on the side wall and the container walls.

FIG. 32 shows the side elevation of the multipack per FIG. 31 with the side wall 220, the encircling band 215, the bottom portion 211 and the cylindrical cans 213.

What is claimed is:

1. A multipack for at least six containers of uniform shape and size disposed in pairs in a side-by-side arrangement, the multipack comprising the containers, a cardboard member for supporting the containers, the cardboard member being a rectangular cardboard blank, the cardboard member comprising a bottom portion, the containers having bottoms, the bottoms of the containers resting at least partially on the bottom portion, the cardboard member further comprising at least two flap portions extending at an angle of 90° to the bottom portion, the flap portions being disposed between the pairs of containers, each flap portion having two web portions connected to the bottom portion at outer edges thereof, and a connecting portion connecting the two web portions, each connecting portion having a slot, a transverse web member having two slots, the two slots of the transverse web member being inserted in the slots of the connecting portions, and at least one encircling band circumferentially surrounding the containers.

2. The multipack according to claim 1, wherein the containers and the flap portions each have a height, wherein the height of the flap portions is equal to the height of the containers.

3. The multipack according to claim 1, wherein the containers and the flap portions each have a height, wherein the height of the flap portions is smaller than the height of the containers.

4. The multipack according to claim 1, wherein the encircling stand is arranged approximately at half the height of the containers.

5. The multipack according to claim 1, comprising two encircling bands, one of the encircling bands being arranged in an upper half of the height of the containers and the other of the encircling bands being arranged in a bottom half of the height of the containers.

6. The multipack according to claim 1, wherein the bottom portion includes an underside, the underside comprising an area for placing imprints or labels thereon.

* * * * *